US005255409A

United States Patent [19]

Fujiwara et al.

[11] Patent Number: 5,255,409

[45] Date of Patent: Oct. 26, 1993

[54] ELECTRIC VACUUM CLEANER HAVING AN ELECTRIC BLOWER DRIVEN IN ACCORDANCE WITH THE CONDITIONS OF FLOOR SURFACES

[75] Inventors: Masakatsu Fujiwara, Kasai; Yasuyuki Tsuchida, Hyogo; Yuji Nakanishi, Kasai; Yoshikazu Morishita, Hyogo, all of Japan

[73] Assignee: Sanyo Electric Co., Ltd., Moriguchi, Japan

[21] Appl. No.: 731,515

[22] Filed: Jul. 17, 1991

[30] Foreign Application Priority Data

Jul. 18, 1990 [JP] Japan ..... 2-191129
Jul. 18, 1990 [JP] Japan ..... 2-191130

[51] Int. Cl.[5] ..... A47L 9/28

[52] U.S. Cl. ..... 15/319; 15/339; 15/412

[58] Field of Search ..... 15/319, 339, 412

[56] References Cited

U.S. PATENT DOCUMENTS 4,328,522 5/1982 Tryan ..... 15/319 X
4,654,924 4/1987 Getz et al. ..... 15/319
4,953,253 9/1990 Fukuda et al. ..... 15/319
4,958,406 9/1990 Toyoshima et al. ..... 15/319
5,023,973 6/1991 Tsuchida et al. ..... 15/319
5,033,151 7/1991 Kraft et al. ..... 15/319

FOREIGN PATENT DOCUMENTS 2063659 6/1981 United Kingdom ..... 15/319

*Primary Examiner*—Chris K. Moore
*Attorney, Agent, or Firm*—Thomas P. Morrison

[57] ABSTRACT

An electric vacuum cleaner comprises a main body having an electric blower and a dust collecting chamber, a triac controlling the electric blower, a floor nozzle coupled to the main body, a pressure sensor sensing the pressure in the vicinity of a suction port of the electric blower, a current sensor sensing the current in a rotary brush driving motor of the floor nozzle, and a microcomputer. The microcomputer performs a fuzzy inference on the outputs of the pressure sensor and the current sensor to determine the duty cycle of the blower control triac on the basis of the result of the inference. By doing this, supply of power to the electric blower in accordance with the condition of a floor surface is realized.

16 Claims, 17 Drawing Sheets

LOOK UP TABLE (DUTY CYCLE OF TRIAC)

SMALL ← CURRENT → LARGE

| | | | | | | | | | | |
|---|---|---|---|---|---|---|---|---|---|---|
| 151 | 145 | 145 | 145 | 145 | 151 | 151 | 151 | 151 | 41 | 41 |
| 145 | 145 | 151 | 145 | 145 | 151 | 151 | 151 | 151 | 41 | 41 |
| 99 | 110 | 116 | 134 | 139 | 151 | 151 | 151 | 151 | 41 | 41 |
| 99 | 99 | 105 | 145 | 145 | 151 | 151 | 151 | 151 | 41 | 41 |
| 41 | 41 | 41 | 41 | 41 | 41 | 41 | 41 | 41 | 41 | 41 |

SMALL ← PRESSURE → LARGE

[RULE 5]

[RULE 6]

[RULE 7]

ELECTRIC VACUUM CLEANER HAVING AN ELECTRIC BLOWER DRIVEN IN ACCORDANCE WITH THE CONDITIONS OF FLOOR SURFACES

BACKGROUND OF THE INVENTION

1. Field of the Invention

The present invention relates to an electric vacuum cleaner and, more particularly, to an electric vacuum cleaner in which the input to an electric blower is automatically controlled in accordance with the conditions of floor surfaces.

2. Description of the Background Art

Conventionally, a technique was proposed for improving the convenience of use of an electric vacuum cleaner by changing the input to an electric blower, i.e. the supply of power, in accordance with the magnitude of the load of suction and the amount of duct collected in a dust collecting chamber. Such a conventional technique as proposed includes a pressure detecting device provided in an air inlet passage between an electric blower and a filter. The pressure in the dust collecting chamber is detected by the pressure detecting device, and input to the electric blower is controlled in accordance with the detected pressure value. An electric vacuum cleaner using such a technique is disclosed, for example, in Japanese Patent Laying-Open No. 57-75623 (1982).

In such a conventional technique, however, input to the electric blower was controlled merely in accordance with detection of the pressure in the dust collecting chamber, and it was difficult to perform optimum input control adapted to the actual condition of the floor surface which is subject to dust collection.

For example, on of the surface of a board floor, the suction port of the electric vacuum cleaner tends to cling to the floor surface, and once it clings to the floor, the pressure in the air inlet passage is lowered. In such a case, input to the electric blower is increased in accordance with the decrease of detected output of the pressure detecting device to make the suction power still greater, so that the suction port clings to the floor surface still harder. As described above, there was a problem in the conventional electric vacuum cleaner, in that input control of the electric blower adapted to the actual condition of the floor surface was not performed, and convenience of use was not sufficiently improved.

Another approach is disclosed in Japanese Patent Laying-Open No. 64-52430 (1989), for example, in which suction power in accordance with the type of a floor surface is realized by sensing the change in electric current in a driving motor of a dust collecting rotary brush provided in a suction element of the vacuum cleaner and automatically controlling input to an electric blower on the basis of the sensed output. However, during normal cleaning, the change in current in the motor driving the rotary brush is extremely small, and, particularly, little change occurs in the average current. Therefore, it is difficult to perform fine input control of the electric blower in accordance with the type or the condition of the floor merely by controlling input to the electric blower in proportion to the current in the driving motor of the rotary brush as in the above described conventional technique.

OBJECTS AND SUMMARY OF THE INVENTION

An object of the present invention is to provide an electric vacuum cleaner capable of realizing optimum suction power in accordance with the actual condition of a floor surface.

Another object of the present invention is to provide an electric vacuum cleaner capable of automatically supplying optimum electric power to an electric blower in accordance with the actual condition of a floor surface.

Still another object of the present invention is to provide an electric vacuum cleaner capable of precisely determining the actual condition of a floor surface in a manner close to human sensing by controlling input to an electric blower using fuzzy inference procedure to realize optimum suction power.

In brief, the present invention provides an electric vacuum cleaner comprising a main body having an electric blower and a dust collecting chamber, a floor nozzle coupled to the main body, a pressure sensor sensing the pressure of the suction side of the electric blower, a floor sensor sensing the condition of a floor surface, and a control circuit performing prescribed mathematical operations on an output of the pressure sensor and an output of the floor sensor to control the supply of power to the electric blower based on the result of the operations.

In accordance with another aspect of the present invention, prescribed mathematical operations on the outputs of a pressure sensor and floor sensor are performed using the fuzzy inference procedure.

In accordance with still another aspect of the present invention, a floor suction element includes a rotary brush driven by a driving motor, a floor sensor senses the current in the driving motor with a current sensor, and control of an electric blower is performed on the basis of the peak value of the detected value.

Accordingly, it is a main advantage of the present invention that optimum power in accordance with the condition of a floor surface can be supplied to an electric blower, and optimal suction power can be realized as well, since prescribed mathematical operations are performed on the pressure of the suction side of an electric blower and an output of a floor sensor, that shows the condition of the floor surface, thereby controlling the supply of power to an electric blower on the basis of the result.

It is another advantage of the present invention that automatic input control of an electric blower adapted to human experience and intuition can be realized with a simple configuration by using the fuzzy inference procedure in a series of mathematical operations performed on the outputs of a pressure sensor and a floor sensor.

It is still another advantage of the present invention that fine input control of an electric blower in response to the condition of a floor surface can be performed, since input to an electric blower is controlled on the basis of the peak current value of a brush driving motor.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7(A)' is an enlargement of the section of FIG. 7(A) within the ellipse bounded by a dashed line.

DESCRIPTION OF THE PREFERRED EMBODIMENTS

Figure 1:
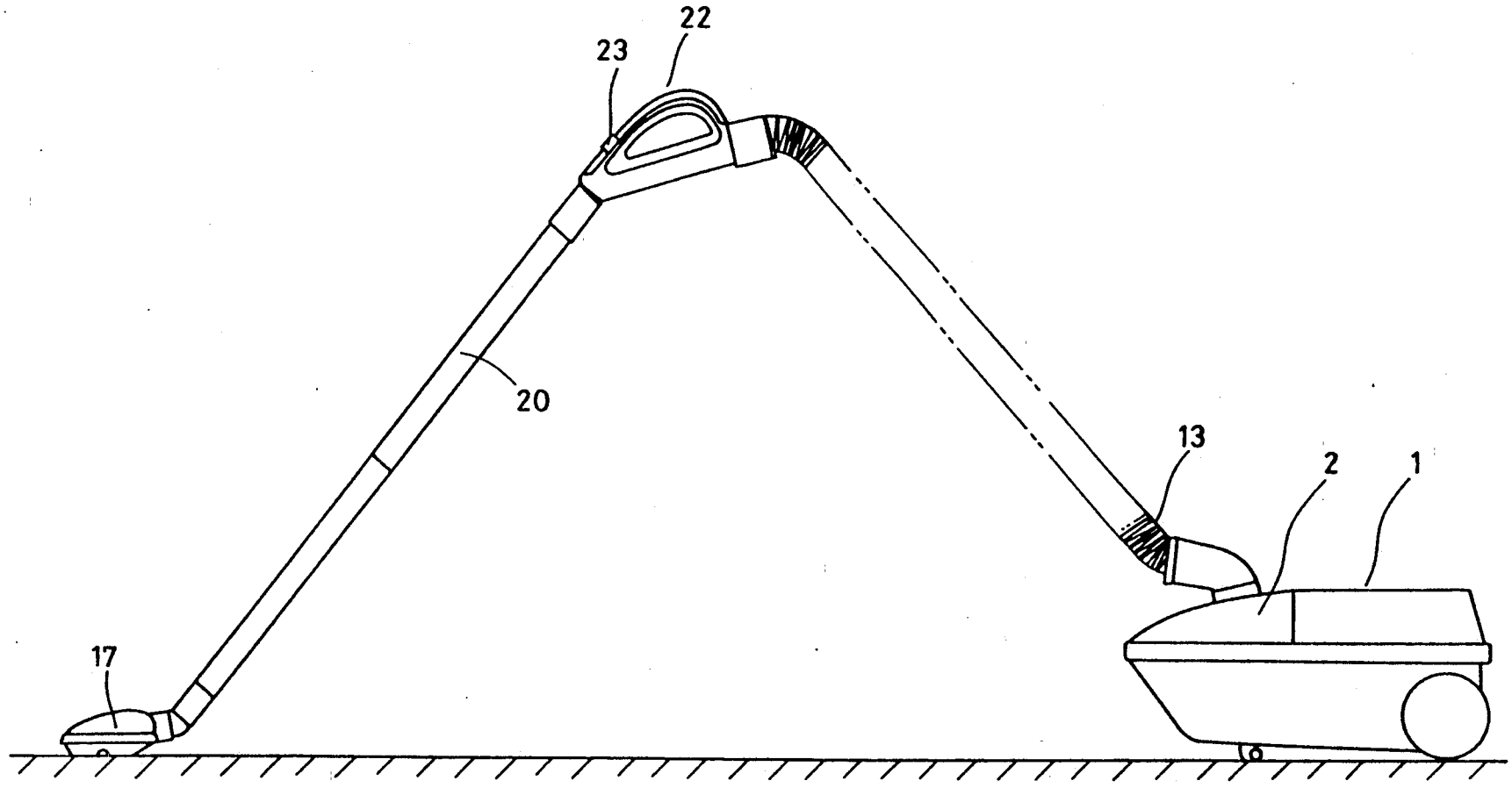
FIG. 1 is an overall outside view of an electric vacuum cleaner according to an embodiment of the present invention.

First, referring to FIG. 1, an electric vacuum cleaner according to an embodiment of the present invention comprises, as a whole, a main body 1, a suction hose 13 having one end attached to a suction port of a lid 2 provided in the front part of it, a handle part 22 having a sliding operation part 23 provided at the other end of hose 13, an extension pipe 20 connected to handle part 22, a floor nozzle 17 connected to the tip of extension pipe 20.

Next, referring to FIGS. 2 and 3, the configuration of main body 1 of the electric vacuum cleaner illustrated in FIG. 1 will be described in detail. A dust collecting chamber 3 having an opening to be opened and closed by lid 2 on the upper surface is provided in the front part of main body 1 of the electric vacuum cleaner. A blower accommodating chamber 6 is provided in the rear part of main body 1, and blower accommodating chamber 6 communicates with dust collecting chamber 3 through a vent hole 4, and an exhaust port 5 is formed on its back wall.

An electric blower 7 is accommodated in blower accommodating chamber 6, and a suction port 7*a* of electric blower 7 communicates with the above described dust collecting chamber 3 in an airtight manner. A box type filter 8 permeable to air is accommodated in an attachable/detachable manner in dust collecting chamber 3, and a paper bag filter 9 is accommodated in an attachable/detachable manner in box type filter 8. A suction filter 10 is provided in front of (at the suction side of) electric blower 7, and an exhaust filter 11 is provided in the rear (at the exhaust side).

A suction port part 12 to which suction hose 13 (FIG. 1) is coupled in a rotatable manner is provided in lid 2 in the front part of main body 1. Described in more detail with reference to FIGS. 2 and 3, suction port part 12 includes a suction port 14, a hose coupling nozzle 15 holding suction hose 13 in a rotatable manner, and a slide-type shutter plate 16 placed in the upper part of hose coupling nozzle 15 for opening/closing suction port 14.

On the other hand, a function displaying part 24 is provided at the central part of the upper surface of main body 1. Function displaying part 24 displays a corresponding function by illuminating it from behind with a light emitting diode. Described in further detail, as illustrated in, FIG. 2, function displaying part 24 includes a dust level displaying part 26, a power control displaying part 27, and a fuzzy control displaying part 28. Dust amount displaying part 26 lights one of three light emitting diodes D1–D3 to display the amount of dust in paper bag filter 9 (FIG. 3). Power control displaying part 27 lights one of four light emitting diodes D5–D8 to display suction power of electric blower 7, i.e. the power supplying state of it, with notch display of four steps, i.e. (weak), (medium), (strong), and (high power). Fuzzy control displaying part 28 lights light emitting diode D4 to display that fuzzy control is being performed on electric blower 7, and when electric blower 7 is manually controlled, light emitting diode D4 is turned off.

Figure 3:
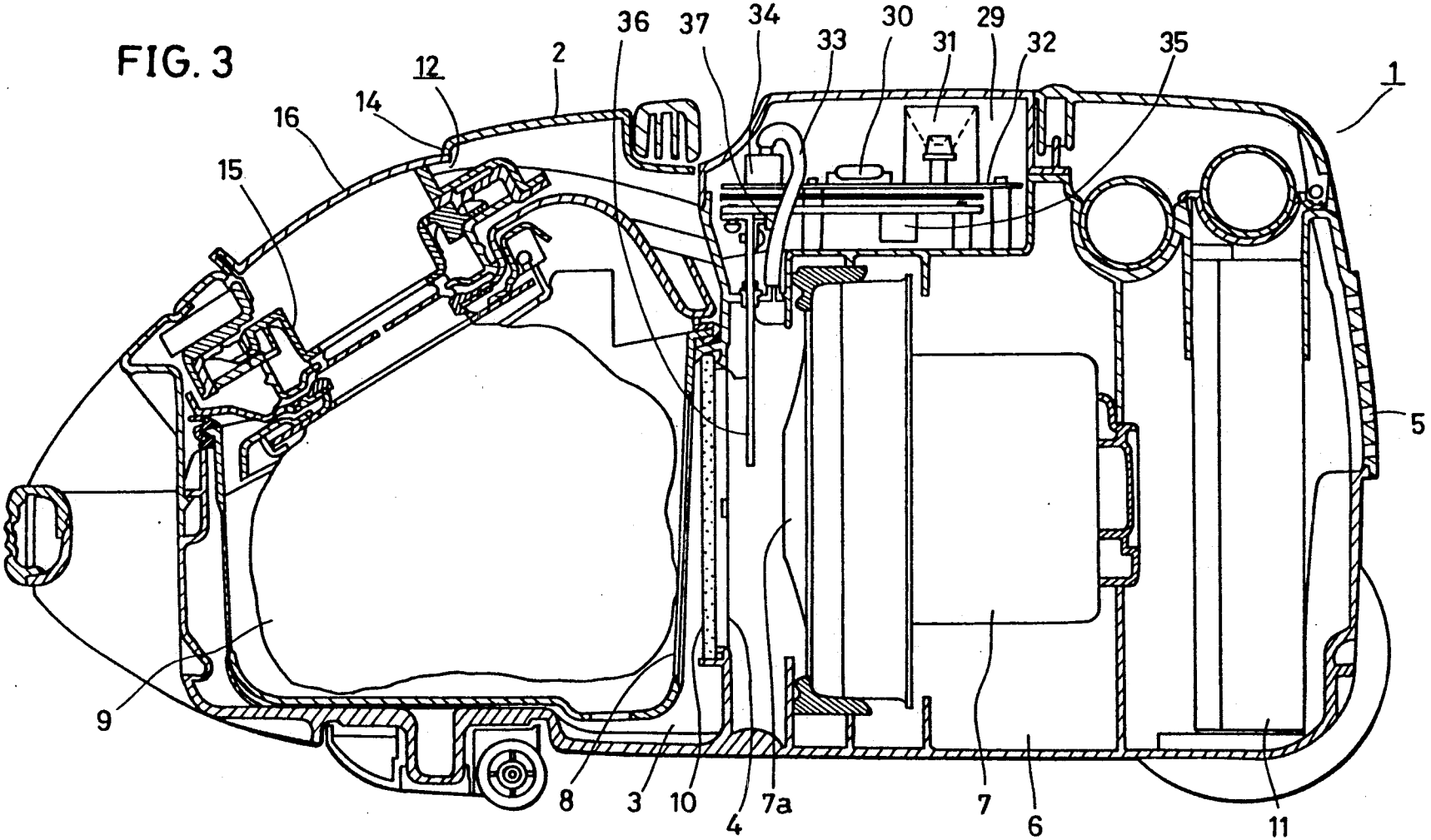
FIG. 3 is a sectional view of a main body of an electric vacuum cleaner according to an embodiment of the present invention.

Referring to FIG. 3, a control board accommodating chamber 29 is formed in the upper part of blower accommodating chamber 6 of main body 1. A control circuit board 32 on which a control circuit device 30, light emitting diodes D1–D8, a reflecting plate 31 and so on are provided is disposed in control board accommodating chamber 29, and accommodating chamber 29 is covered with the above described display panel plate 25. A semiconductor pressure sensor 34, a current sensor 35 and a blower control triac 37 are further attached to control circuit board 32. Semiconductor pressure sensor 34 is coupled through a tube 33 to a space in the vicinity of suction port 7*a* of electric blower 7 and measures the pressure in the vicinity of suction port 7*a*. Current sensor 35 measures the current in a brush driving motor 19 in FIG. 5 which will be described later. Specifically, blower control triac 37 has a radiator plate 36 arranged in a space in the vicinity of suction port 7*a*.

Figure 4:
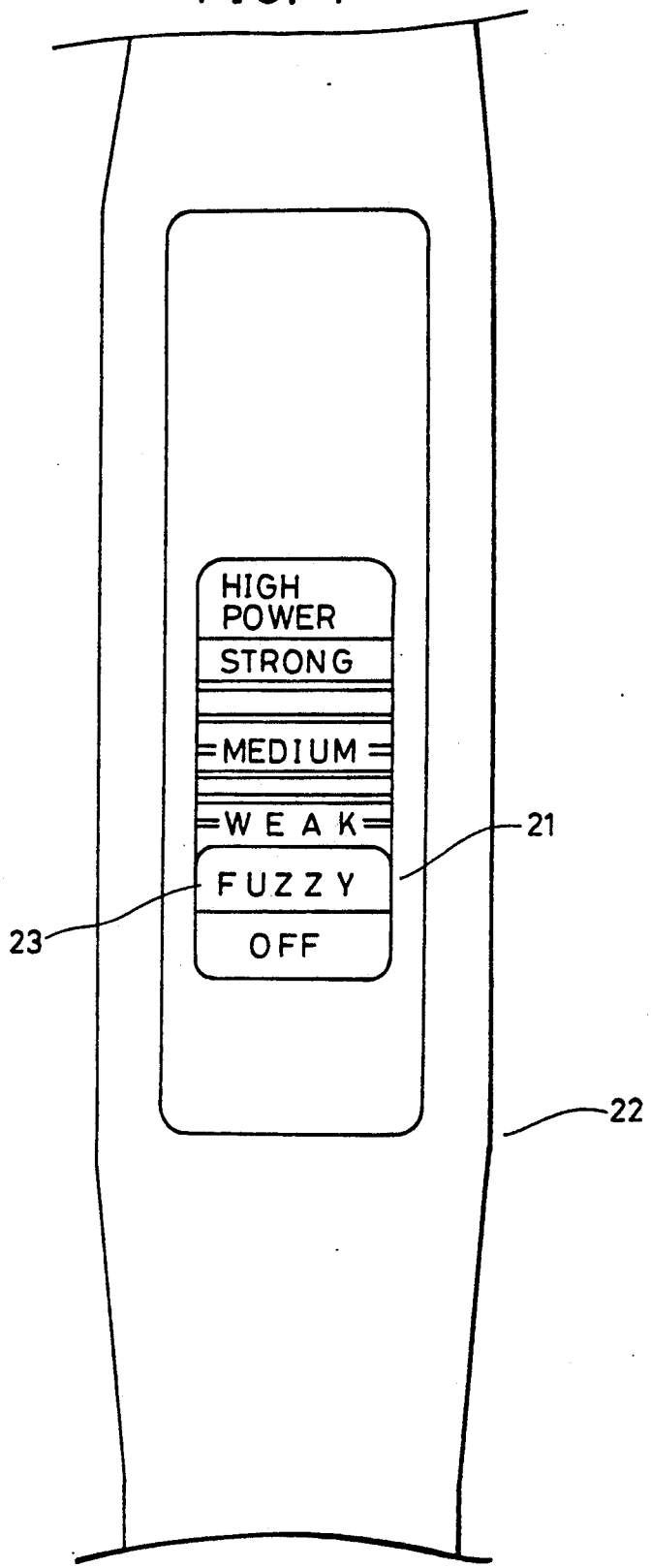
FIG. 4 is a plan view of a handle part of an electric vacuum cleaner according to an embodiment of the present invention.

Next, referring to FIG. 4, details of handle part 22 in FIG. 1 are illustrated. Handle part 22 has an operation part 21 including a sliding operation part 23 on its surface. Sliding operation part 23 is for changing control input to electric blower 7 by changing the position of a slider of a variable resistor (not shown), and has operation setting positions, "off" indicating a stop position, "fuzzy" indicating a fuzzy control position, and "weak-high power" indicating a manual control position.

Figures 5, 12:
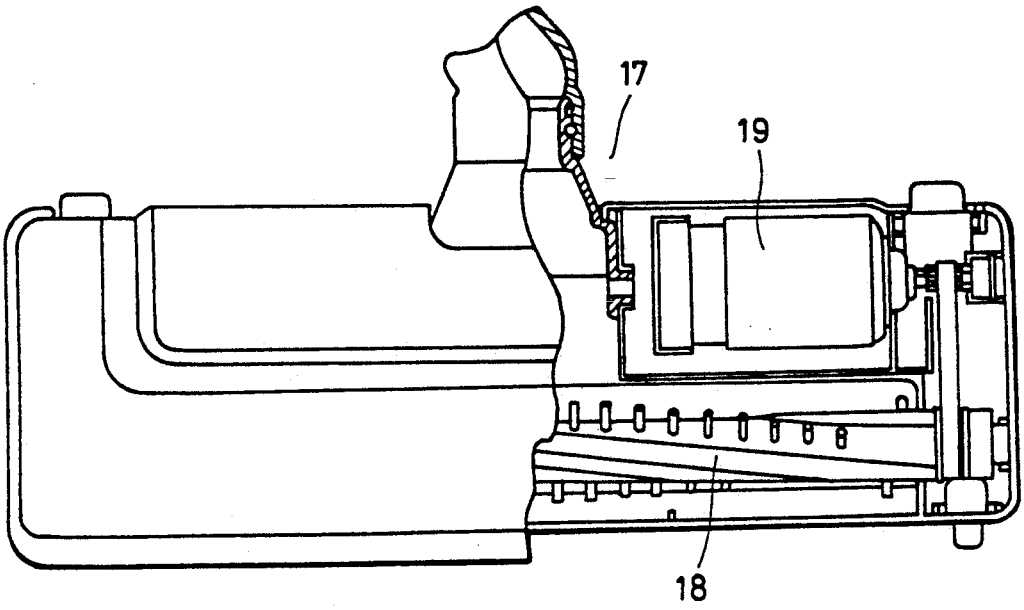
FIG. 5 is a partial sectional view of a floor nozzle of an electric vacuum cleaner according to an embodiment of the present invention.
FIG. 12 is a diagram illustrating a look up table used in input control of an electric blower according to an embodiment of the present invention.

Referring to FIG. 5, a floor nozzle 17 includes at its inside a dust collecting rotary brush 18 and a brush-driving motor 19 driving rotary brush 18.

Next, referring to FIG. 6, description will be made of the configuration of the control part of the electric vacuum cleaner of an embodiment of the present invention illustrated in FIGS. 1 to 5.

A microcomputer 38 comprises an arithmetic operation processing part, an input/output part, a memory part and so on made in one chip and arranged on the control circuit board 32 illustrated in FIG. 3.

An operation notch setting part 39 provided in sliding operation part 23 in FIG. 4 includes a variable resistor (not shown) in which the position of the slider determines the signal voltage input to microcomputer 38 ("off", "fuzzy", "weak", "medium", "strong", or "high power"). Then, microcomputer 38 changes the input (the supply voltage) to electric blower 7 in accordance with the change in the signal voltage.

Furthermore, a pressure sensing part 40 senses a change in the pressure in the vicinity of suction port 7*a* of electric blower 7 on the basis of an output of semiconductor pressure sensor 34 (FIG. 3), and supplies a sensed signal to microcomputer 38.

Figure 2:
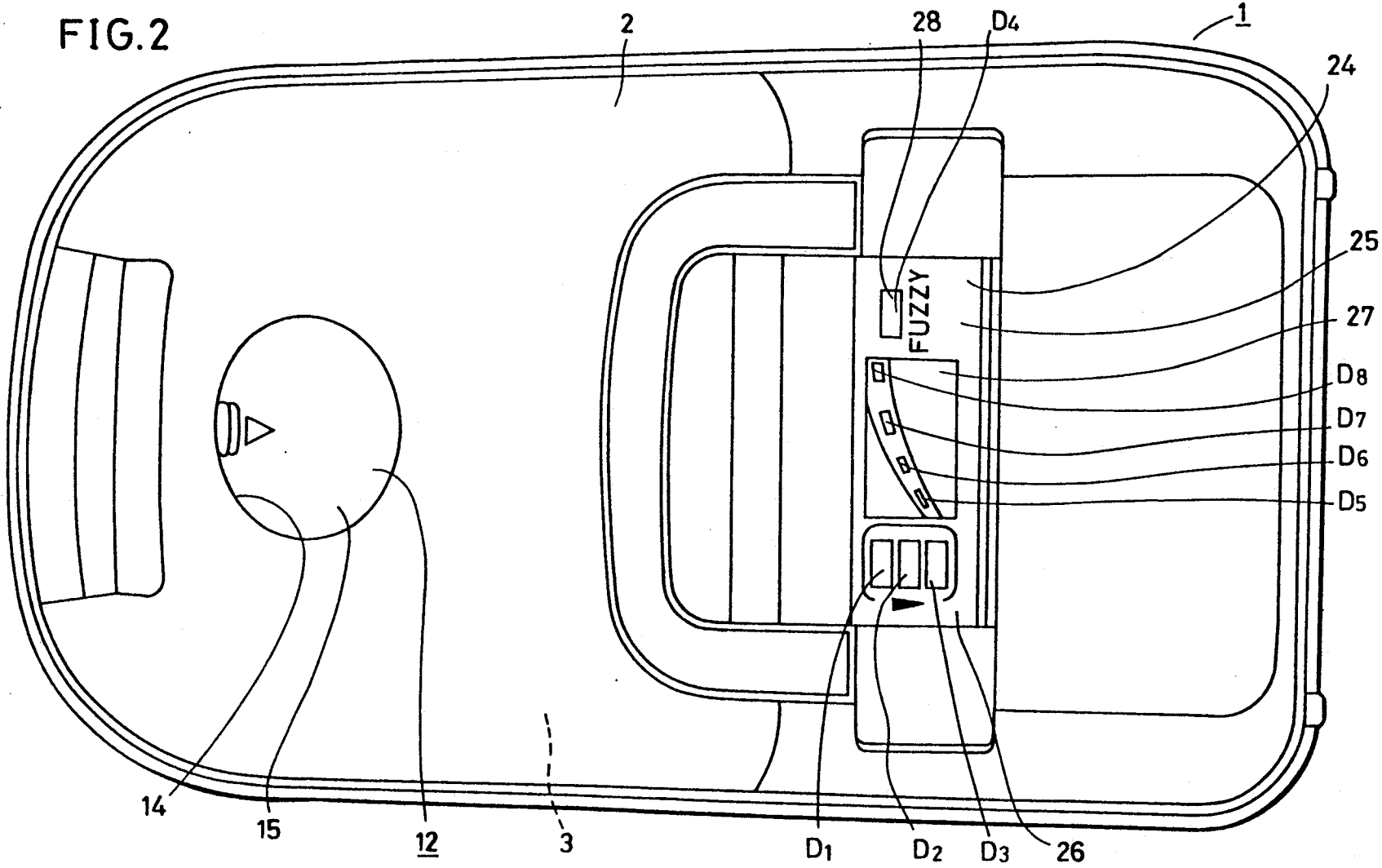
FIG. 2 is a plan view of a main body of an electric vacuum cleaner according to an embodiment of the present invention.

On the other hand, a display driving part 41 controls the display operation of function displaying part 24 illustrated in FIG. 2 in response to a control signal from microcomputer 38. For example, the lighting states of four light emitting diodes D5-D8 of power control displaying part 27 of function displaying part 24 change to display the input control state in accordance with the signal voltage from the above described operation notch setting part 39.

Next, a blower driving part 42 controls blower control triac 37 in response to a control signal from microcomputer 38 to change the power supplied to electric blower 7. Blower driving part 42 and blower control triac 37 constitute a blower controlling part 47.

A current sensing part (a floor sensor) 44 includes a current sensor 35 (FIG. 3) and a peak hold circuit 46 and senses the current in brush driving motor 19 illustrated in FIG. 5. Specifically, the load applied to dust collecting rotary brush 18 (FIG. 5) changes according to the type of a floor surface, for example, whether it is a thick carpet or a thin carpet, whether it is a tatami mat or a board floor, and so on, the current in brush-driving motor 19 changes in accordance with the load, and current sensor 35 detects such a change in the current. The current value detected by current sensor 35 has noise removed through a filter (not shown), and then the current value is supplied to peak hold circuit 46 and its peak value is held. The peak value is supplied to microcomputer 38 for every half cycle or one cycle of the power supply frequency. Then, if supply of the peak value to microcomputer 38 is ended, peak hold circuit 46 is reset, and the next current sensing operation is performed.

A commercial power supply 50 is connected through a power supply part 48 to microcomputer 38. A zero crossing signal generating part 49 generates a zero crossing signal on the basis of an output of power supply part 48 to supply it to microcomputer 38. As described in the following, the zero crossing signal is used for controlling blower control triac 37 and detecting the peak value of the current by current sensing part 44.

Next, referring to FIGS. 7 to 9, description will be made of the operation of detecting the peak value of the current in brush driving motor 19. FIGS. 7A to 7E illustrate waveforms of the current in brush driving motor 19 in (a) the case where no load exist for floor nozzle 17, (b) the case of cleaning a board floor, (c) the case of cleaning a thin carpet, (d) the case of cleaning a carpet with a medium thickness, and (e) the case of cleaning a thick carpet, respectively. In each of FIGS. 7A to 7E, one unit of the abscissa indicates 200 m seconds.

Figure 7A:
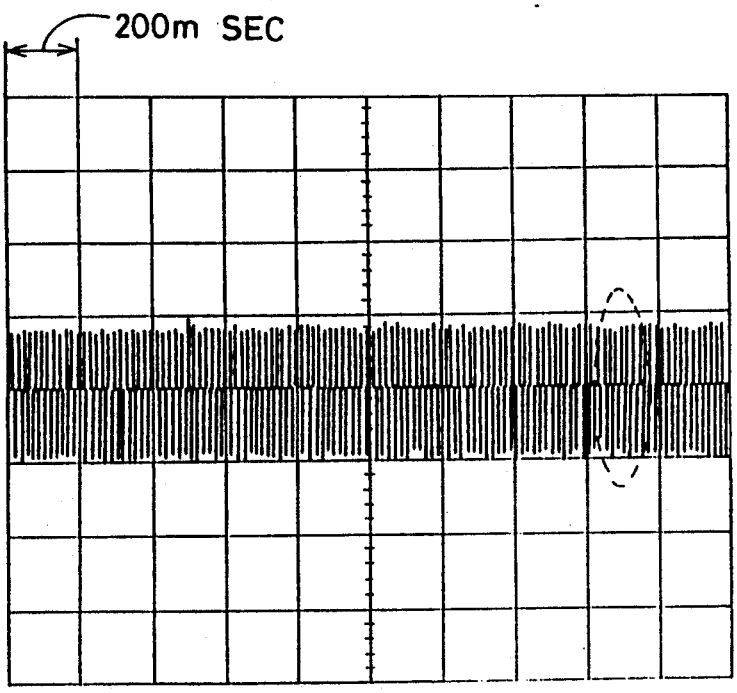
FIGS. 7A to 7E are diagrams illustrating current waveforms of a brush driving motor for various loads according to an embodiment of the present invention.
Figure 7A:
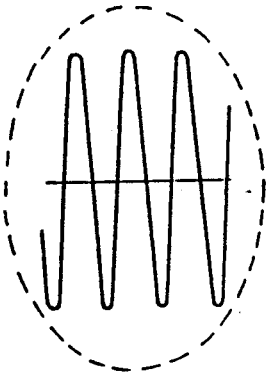
Figure 7B:
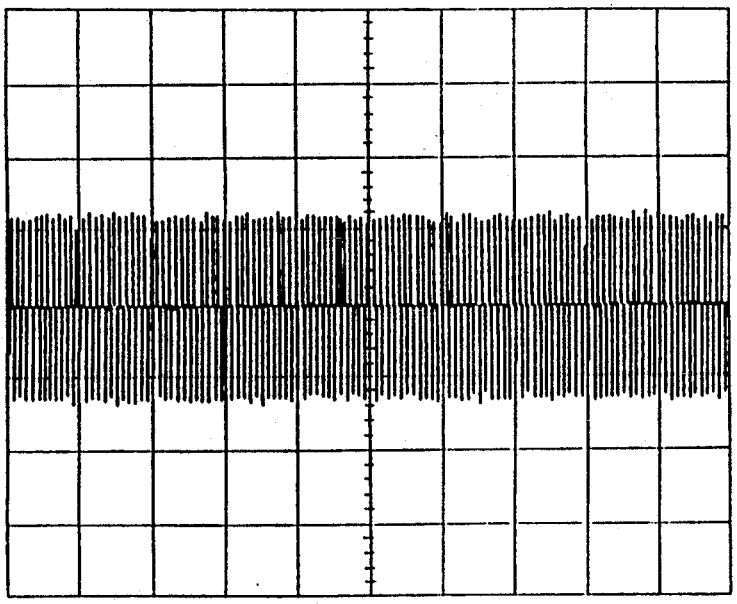
Figure 7C:
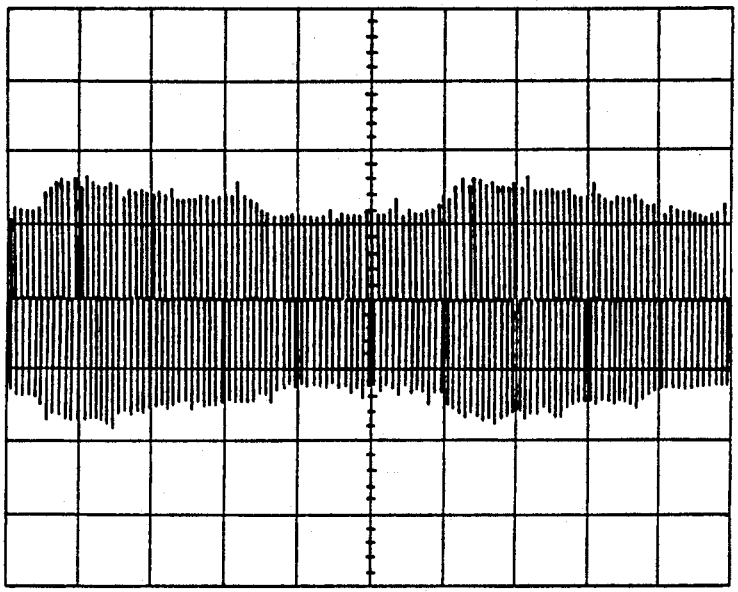
Figure 7D:
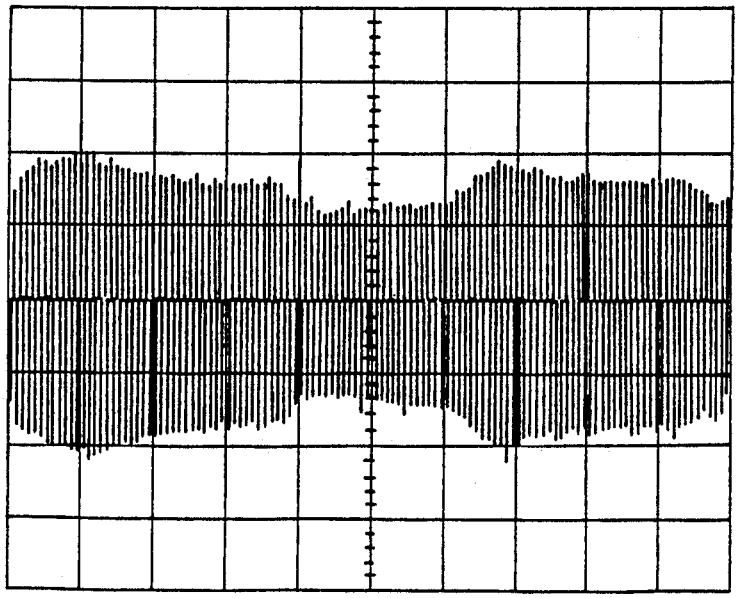
Figure 7E:
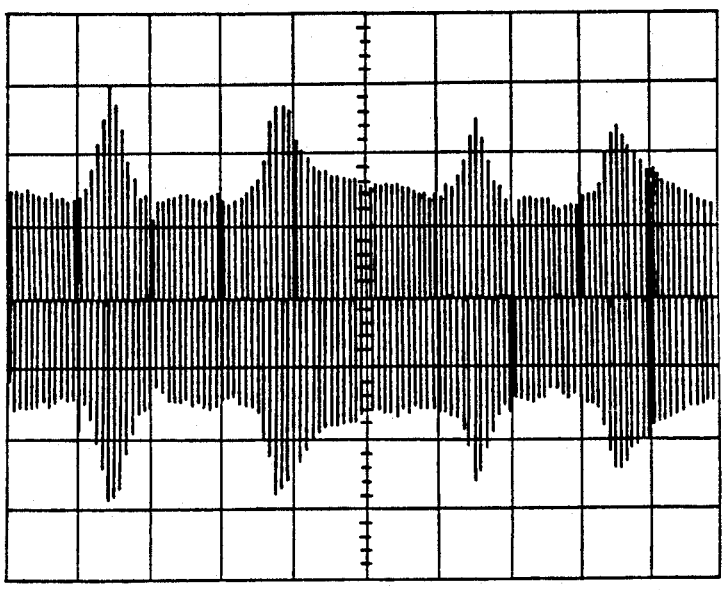

Referring to FIG. 7E, it can be seen that in the case of cleaning a carpet by moving floor nozzle 17 back and forth, the electric current fed to brush-driving motor 19 is greatest when the operation turns from the pulling operation (the back movement) to the pushing operation (the forth movement), and the next largest current flows when the operation turns from the pushing operation (the forth movement) to the pulling operation (the back movement). While the floor nozzle is moved in one direction, the electric current fed to brush-driving motor 19 is almost constant regardless of the thickness of the carpet.

Accordingly, in an embodiment of the present invention, in view of the above described current waveforms illustrated in FIG. 7A to 7E, the peak value of the current value of brush driving motor 19 is detected for every period corresponding to a half cycle or one cycle of the power supply frequency, the maximum value of the detected peak value for a time (for example, for 1.5 seconds in the present embodiment) a little longer than the average time required by one stroke during cleaning, with floor nozzle 17 moved back and forth, is detected, and the type or the condition of the floor surface is determined on the basis of the detected maximum value.

Figure 6:
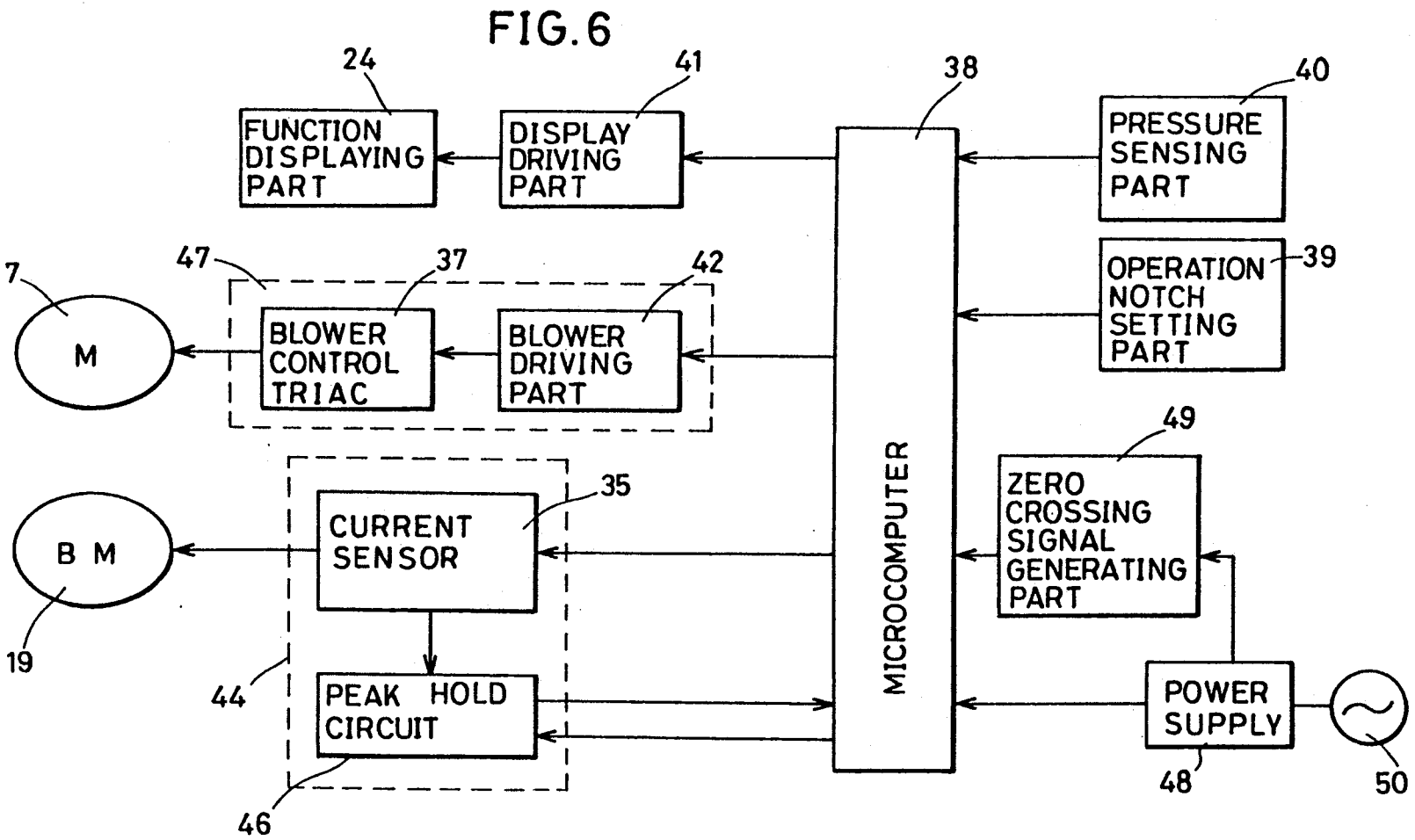
FIG. 6 is a schematic block diagram illustrating a configuration of a control part of an electric vacuum cleaner according to an embodiment of the present invention.
Figure 8:
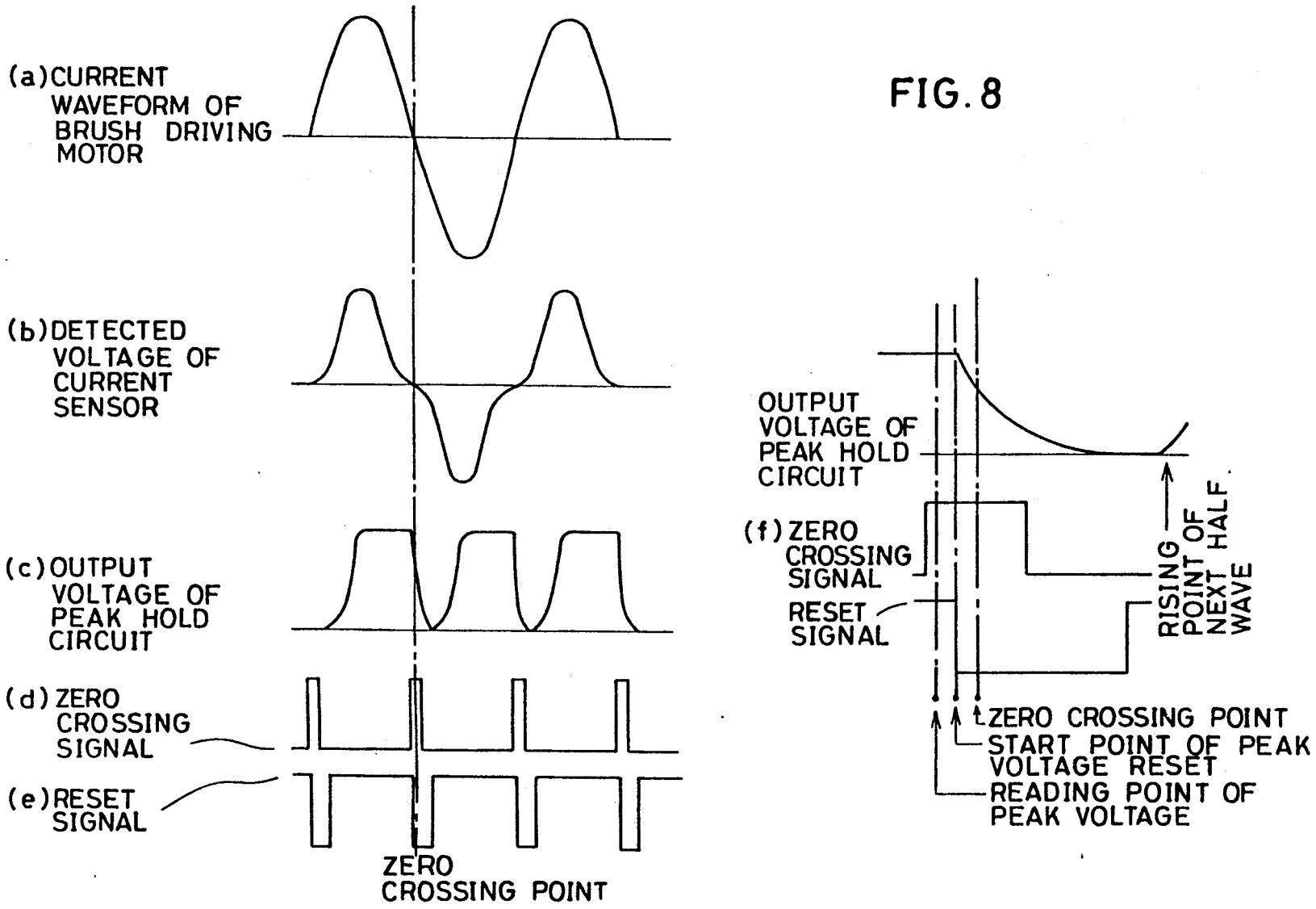
FIG. 8 is a timing chart illustrating the operation of detecting the peak current value of a brush driving motor according to an embodiment of the present invention.
Figure 9:
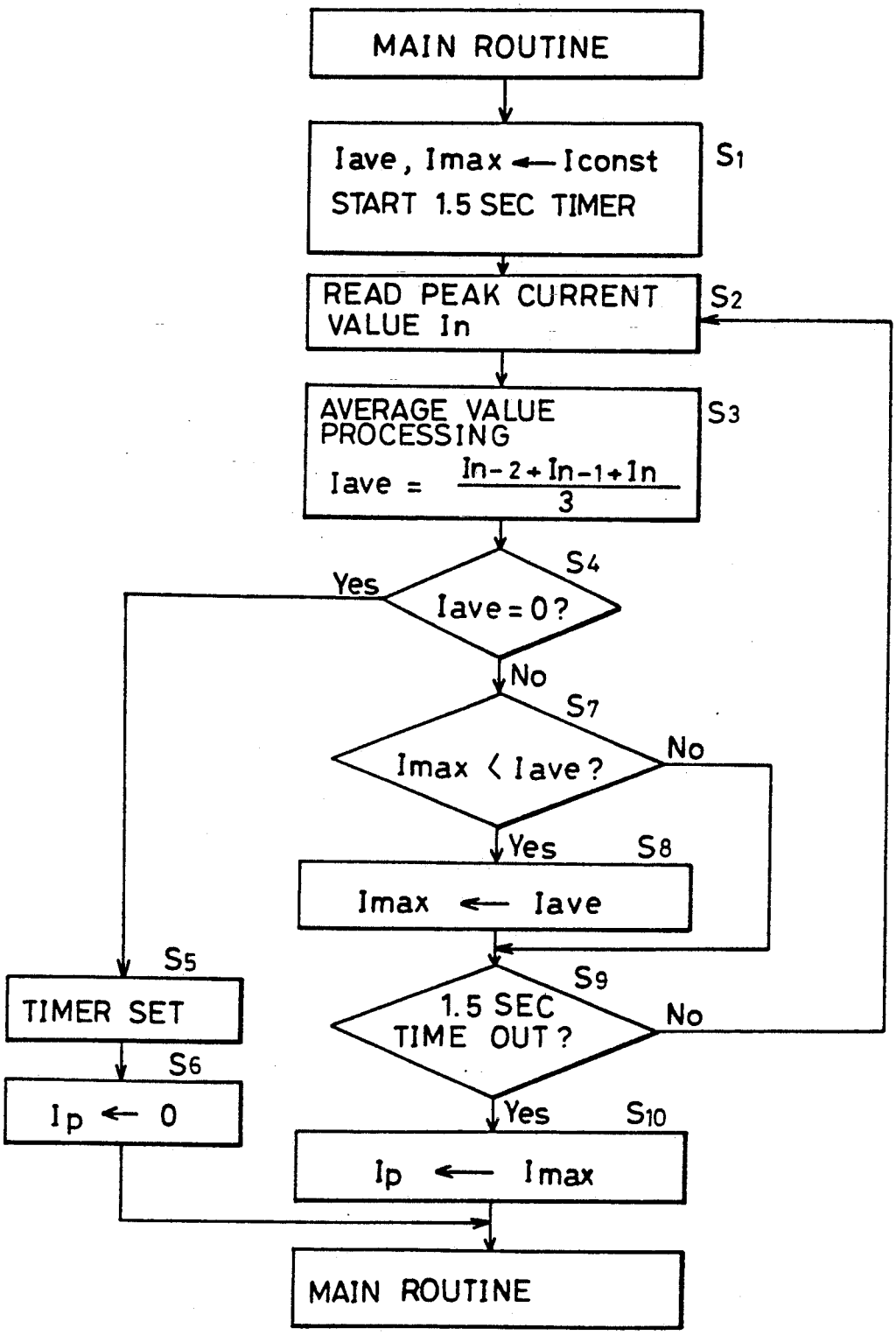
FIG. 9 is a flow chart illustrating the operation of detecting the peak current value of a brush driving motor according to an embodiment of the present invention.

Next, FIGS. 8 (*a*)-(*e*) illustrate waveforms of the current or the voltage in each part of current sensing part 44 illustrated in FIG. 6, and FIG. 8(*f*) is an enlarged waveform diagram illustrating the mutual relationship among FIGS. 8 (*c*), (*d*), and (*e*). Specifically, current sensor 35 in current detecting part 44 detects the current (FIG. 8 (*a*)) in brush driving motor 19 to supply the corresponding detected voltage (FIG. 8 (*b*)) to peak hold circuit 46. Peak hold circuit 46 supplies the peak value (FIG. 8 (*c*)) of the detected voltage as an input to microcomputer 38 in synchronism with a zero crossing signal (FIG. 8 (*d*)) from microcomputer 38. The zero crossing signal is a pulse signal having a constant duration centered at the zero crossing point of the supply voltage waveform (FIG. 8 (*f*)). After the peak value is supplied as an input to microcomputer 38, the peak value held in peak hold circuit 46 is reset in synchronism with a reset signal (FIG. 8 (*e*)) from microcomputer 38. As illustrated in FIG. 8 (*f*), the reset signal is a pulse signal falling a constant time later than the rise of the zero crossing signal.

Next, referring to FIG. 9, description will be made of a method of processing performed on an output of peak hold circuit 46 by microcomputer 38. First, a constant $I_{const}$ is substituted for the average value $I_{ave}$ and the maximum value $I_{max}$ of the peak current, and timing by a 1.5-second timer is started (the step S1). Next, the peak value $I_n$ (represented as the detected current of peak hold circuit 46) in a half cycle of the current in brush driving motor 19 is read therein from peak hold circuit 46 (the step S2), and the average value of $I_n$, the peak value $I_{n-1}$ in the last half cycle, and the peak value $I_{n-2}$ in the half cycle before the last half cycle are evaluated and substituted for the average value $I_{ave}$ (the step S3).

As a result, if $I_{ave}$ is zero (the step S4), the current in brush driving motor 19 is zero, so that it is determined that brush driving motor 19 has stopped or is in trouble, the 1.5-second timer is set (the step S5), the peak current value $I_p$ is made zero (the step S6), and the program returns to a main routine described in the following.

On the other hand, if $I_{ave}$ is not zero (the step S4), $I_{ave}$ is compared with $I_{max}$ (the step S7), and if I is larger, $I_{max}$ is updated to $I_{ave}$ (the step S8). Now, the time required by one stroke of the back and forth movement of floor nozzle 17 is approximately one second, so that there is a high possibility that the peak value of the current in brush-driving motor 19 exists in the period of 1.5 seconds as described above. Therefore, the above described steps S1–S4 and S7–S8 are repeatedly performed by the end of timing by the 1.5-second timer (the step S9), and the largest value $I_{max}$ of the peak current during the period of 1.5 seconds is found and made to be the peak current value $I_p$ of brush-driving motor 19 (the step S10). Then, the program returns to the main routine.

Figure 10:
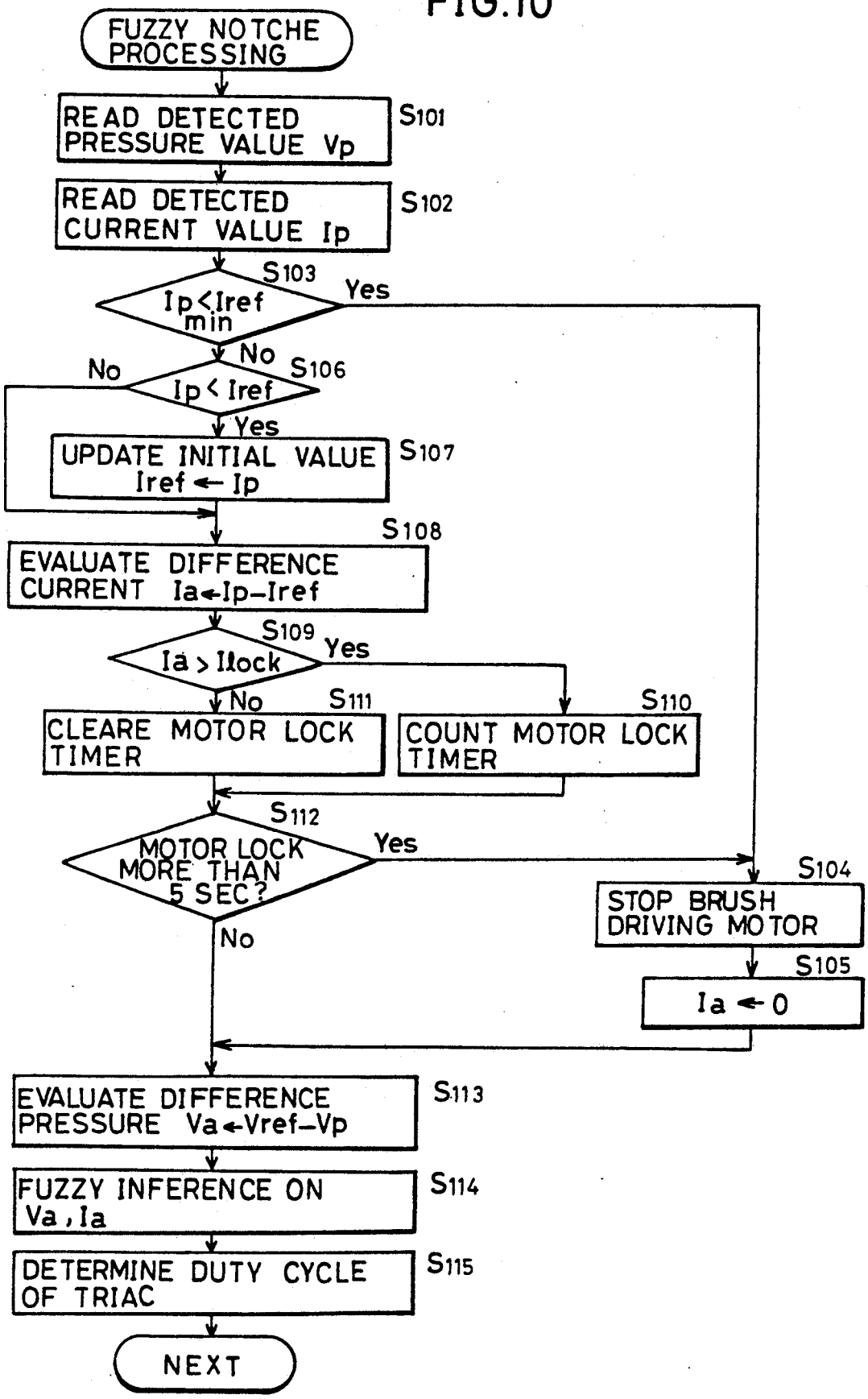
FIG. 10 is a flow chart illustrating a main routine of input control of an electric blower according to an embodiment of the present invention.

Next, referring to FIG. 10, description will be made of the operation of the main routine of an embodiment of the present invention. First, if sliding operation part 23 of operation notch setting part 39 (FIG. 6) is set to the fuzzy control position "fuzzy", the voltage $V_p$ corresponding to the pressure P in the dust collecting chamber detected by semiconductor pressure sensor 34 is read from pressure sensing part 40 (FIG. 6) into microcomputer 38 (the step S101), and the peak current value $I_p$ of brush-driving motor 19 is read into microcomputer 38 in the manner already described with reference to FIG. 9 (the step S102).

Next, the peak current value $I_p$ is compared with a comparison minimum value $I_{refmin}$ stored in advance in the memory part in microcomputer 38 (the step S103). Then, when it is determined that $I_p$ is smaller, microcomputer 38 concludes that rotary brush 18 has become detached and stops brush-driving motor 19 (the step S104).

Figure 11:
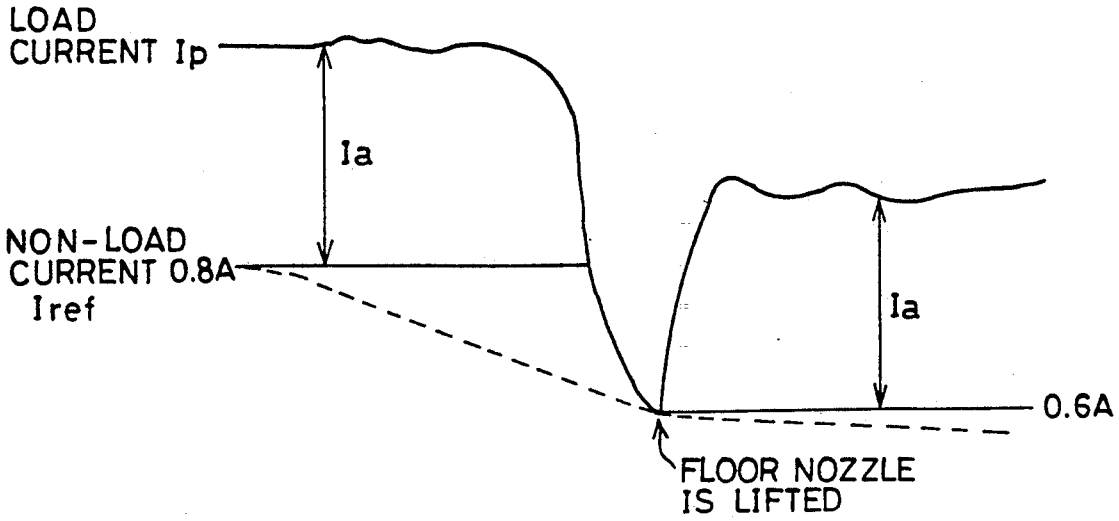
FIG. 11 is a waveform diagram supplementally describing the control operation of the electric blower illustrated in FIG. 10.

On the other hand, when $I_p$ is larger, it is further compared with a comparison reference value $I_{ref}$ (the step S106). As illustrated in FIG. 11, the comparison reference value $I_{ref}$ is the initial value (for example 0.8 A) of the current in brush-driving motor 19 in the no-load condition, stored in advance in the memory part of microcomputer 38. As indicated by a dotted line in FIG. 11, the current in the no-load condition gradually decreases as the temperature of brush-driving motor 19 rises. Accordingly, in order to find the correct current value of brush-driving motor 19, it is necessary to find the difference between the detected load current value and the varied actual no-load current value. In order to find the varied no-load current value, if the no-load current in brush-driving motor 19 becomes not more than $I_{ref}=0.8$ A (for example, 0.6 A) the moment floor nozzle 17 is lifted, for example, the current value may be a new comparison reference value $I_{ref}$. Therefore, in the step S106 in FIG. 10, when the current value $I_p$ is smaller than the comparison reference value $I_{ref}$, $I_{ref}$ can be replaced by the current value $I_p$ (the step S107). As described above, before $I_{ref}$ is changed, the difference $I_n=I_p-I_{ref}$ between the load current value $I_p$ and the initial comparison reference value $I_{ref}$ (0.8 A) is evaluated as a real load current (the step S108), and, after $I_{ref}$ is updated, the difference $I_a=I_p-I_{ref}$ between the load current value $I_p$ and the comparison reference value $I_{ref}$ (0.6 A) after updating is evaluated as a real load current (the step S108).

Then, the real load current value $I_n$ evaluated as described above is compared with the current where the brush of brush-driving motor 19 is locked, i.e., the current $I_{lock}$ where a piece of cloth and so on cling to rotary brush 18 to stop its rotation (the step S109), which is stored in the memory part of microcomputer 38. Then, where the load current $I_a$ is larger than the current $I_{lock}$, timing by a self-contained motor lock timer (not shown) in microcomputer 38 is started to determine whether rotary brush 18 is actually in the locked condition or not (the step S110). Then, where $I_a$ is larger even if the value of the motor lock timer is more than a prescribed value (for example, 5 seconds) (the step S112), it is determined that rotary brush 18 is actually locked, and supply of current to brush-driving motor 19 is stopped to prevent burnout of brush-driving motor 19 (the step S104) and let the value of the load current $I_n$ be zero (the step S105). On other hand, where the load current $I_a$ is smaller than the current $I_{lock}$ from the beginning or where it becomes smaller than $I_{lock}$ during timing by the motor lock timer, it is determined that rotary brush 18 is actually not locked, and then the motor lock timer is cleared (the step S111), and the program proceeds to the next step.

In the next step S113, the detected value $V_p$ of semiconductor pressure sensor 34 is compared with the comparison reference value $V_{ref}$ stored in the memory part of microcomputer 38, and $V_a=V_{ref}-V_p$ is evaluated (the step S113).

Then, the duty cycle (or conduction angle) of blower control triac 37 is determined on the basis of the values $I_a$ and $V_a$ found as described above and in a look up table as illustrated in FIG. 12 stored in advance in microcomputer 38 (the steps S114 and S115) to control input to electric blower 7.

Now, the fuzzy inference procedure is employed in controlling input to above described electric blower 7, in which information with fuzzy boundary is processed as is. In other words, the look up table (FIG. 12) used in the steps S114 and S115 in FIG. 10 is derived from the fuzzy inference procedure. In the fuzzy inference procedure, the production rules are the following

[Rule 1]

If the pressure is small and the current is somewhat small, then the input is about medium.

[Rule 2]

If the pressure is small and the current is large, then the input is large.

[Rule 3]

If the pressure is about medium and the current is somewhat small, then the input is somewhat large.

[Rule 4]

If the pressure is about medium and the current is about medium, then the input is large.

[Rule 5]

If the pressure is somewhat large and the current is about medium, then the input is large.

[Rule 6]

If the input is large and the current is very small, then the input is small.

[Rule 7]

If the current is very small, then the input is small.

Figure 13:
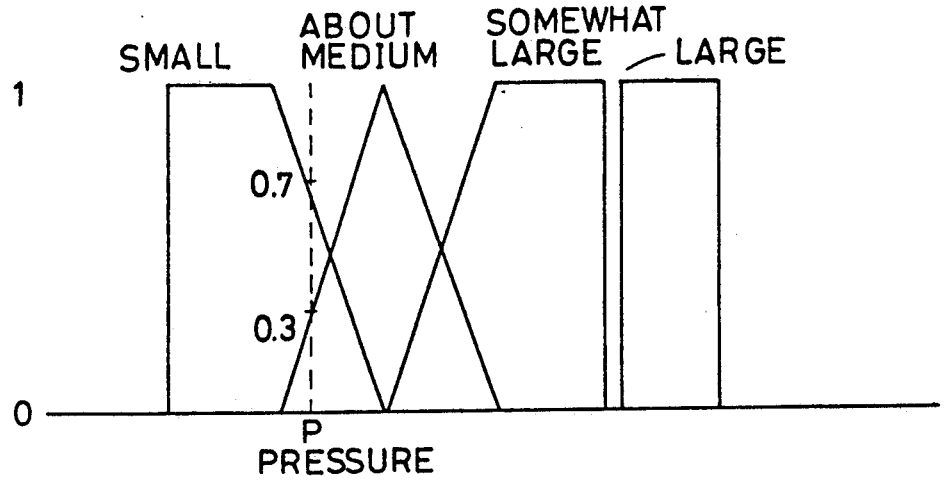
FIGS. 13 and 14 are graphs illustrating membership functions for input variables according to an embodiment of the present invention.
Figure 14:
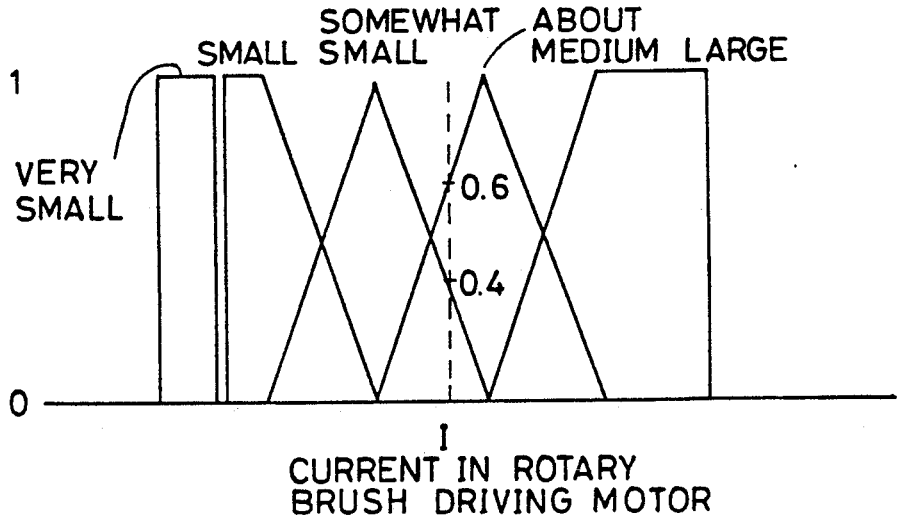
Figure 15:
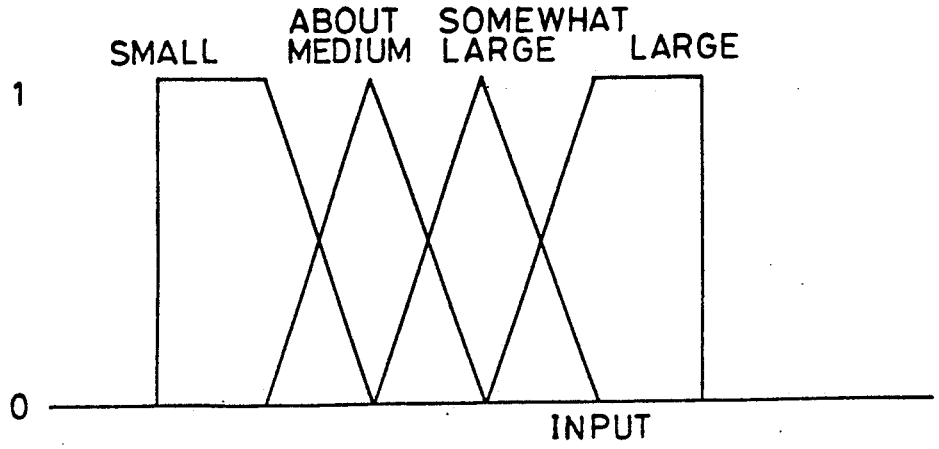
FIG. 15 is a graph illustrating a membership function for a conclusion part according to an embodiment of the present invention.

In these rules, as shown in FIGS. 13 and 14, the conditions such as "large", "small" are defined by membership functions for input variables of the detected value P of semiconductor pressure sensor 34 and the current value I of brush-driving motor 19, which changes with the condition of a floor. The conclusion part is the input value of electric blower 7, i.e., the duty cycle of blower control triac 43, defined by the membership function shown in FIG. 15. The inference is performed using the MAX-MIN synthesis method, and the conclusion is determined by the centroid method of defuzzifier processing.

Now, each of the above described rules will be discussed in detail.

Figure 16:
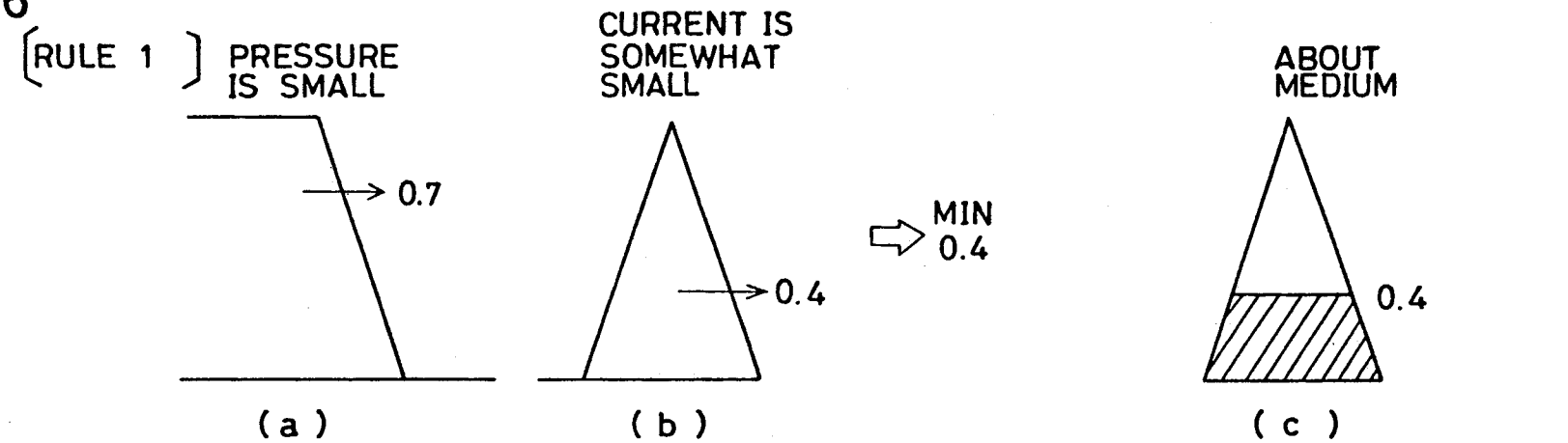
FIG. 16 is a graph illustrating a membership function of rule 1 of an embodiment of the present invention.

[Rule 1] is defined by such membership functions as all shown in FIGS. 16 (*a*), (*b*) and (*c*). FIG. 16 (*a*) is a graph for obtaining a membership value indicating the degree of satisfaction of the first condition rule 1 of "the pressure is small", which indicates a membership function for a pressure detection value P as an input variable. A membership value (for example 0.7) is obtained by substituting the pressure detection value P into the membership function, as shown in FIG. 13.

FIG. 16 (b)is a graph for obtaining a membership value indicating the degree of satisfaction of the second condition of rule 1 of "the current is somewhat small", which indicates a membership function for the current detection value I as an input variable. A membership value (for example, 0.4) is obtained by substituting the current detection value I into the membership function, as shown in FIG. 14.

FIG. 16 (*c*) is a graph showing the conclusion "the input is about medium", which indicates a membership function for the duty cycle of the blower control triac as the conclusion part of rule 1. The smaller value (0.4) of the membership values of the first and second conditions of rule 1 is specified on the ordinate indicating the membership value of FIG. 16 (*c*). The region indicated by the membership function of FIG. 16 (*c*) is divided into two areas by a line corresponding to the specified membership value (0.4), and the region, indicated by oblique lines, which does not exceed the membership value corresponds to an inference result obtained by applying each of the actually detected values to rule 1.

Figure 17:
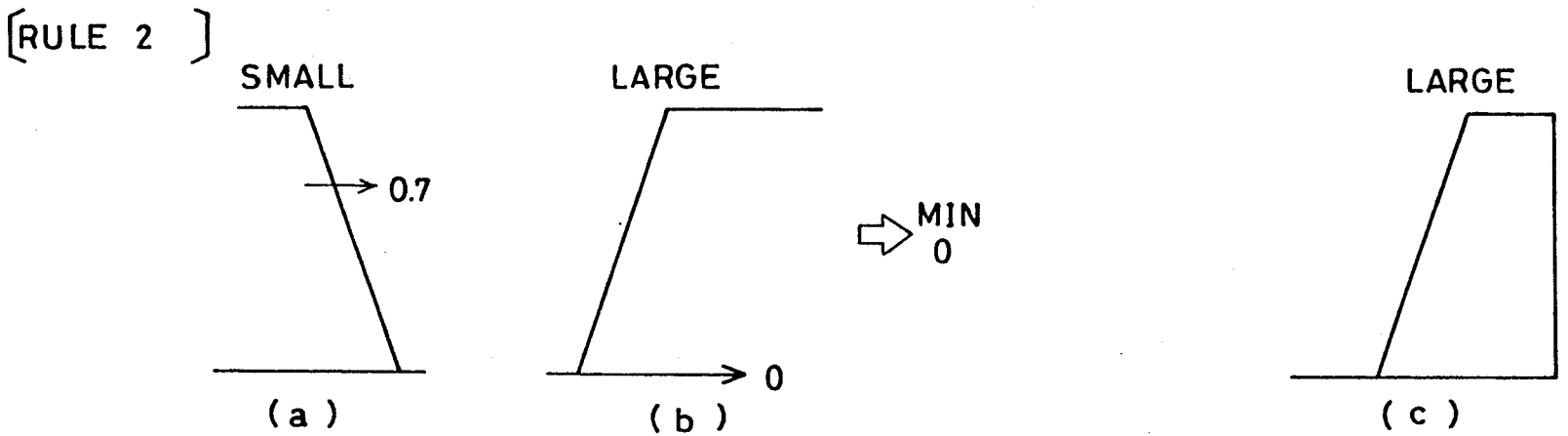
FIG. 17 is a graph illustrating a membership function of rule 2 of an embodiment of the present invention.

[Rule 2] is defined by such membership functions as are shown in FIGS. 17 (*a*), (*b*) and(*c*). FIG. 17 (*a*) is a graph for obtaining a membership value indicating the degree of satisfaction of the first condition of rule 2 "the pressure is small", which indicates a membership function for pressure detection value P as an input variable. A membership value (for example, 0.7) is obtained by substituting the pressure detection value P into the membership function.

FIG. 17 (*b*) is a graph for obtaining a membership value indicating the degree of satisfaction of the second condition of rule 2 of "the current is large", which indicates a membership function for the current detection value I as an input variable. A membership value (for example, zero)is obtained by substituting the current detection value I into the membership function.

FIG. 17 (*c*) is a graph showing the conclusion "the input is large", which indicates a membership function for the duty cycle of the blower control triac as the conclusion part of the rule 2. The smaller value (zero) of the membership values of the first and second conditions of rule 1 is specified on the ordinate indicating the membership value of FIG. 17 (*c*). The region indicated by the membership function of FIG. 17 (*c*) is divided into two areas by a line corresponding to the specified membership value (zero), and the region which does not exceed the membership value corresponds to an inference result obtained by applying each of actually detected values to rule 2.

Figure 18:
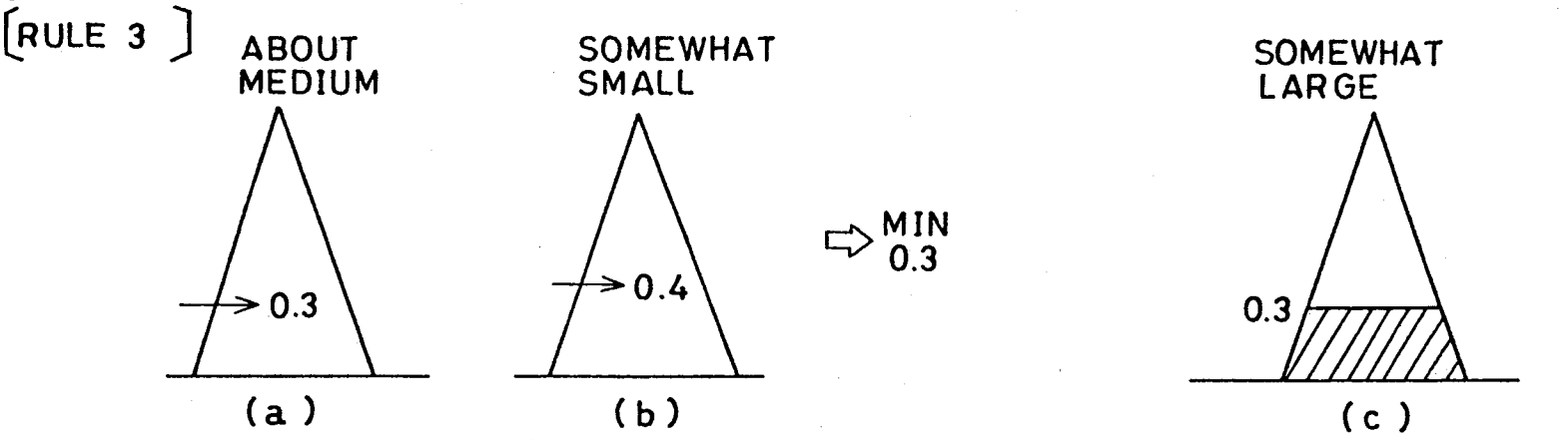
FIG. 18 is a graph illustrating a membership function of rule 3 of an embodiment of the present invention.

[Rule 3] is defined by such membership functions as are illustrated in FIGS. 18 (*a*), (*b*) and (*c*). FIG. 18 (*a*) is a graph for obtaining a membership value indicating the degree of satisfaction of the first condition rule 3 of "the pressure is about medium", which indicates a membership function for the pressure detection value P as an input variable. A membership value (for example, 0.3) is obtained by substituting the pressure detection value P into the membership function.

FIG. 18 (*b*) is a graph for obtaining a membership value indicating the degree of satisfaction of the second condition of rule 3 of "the current is somewhat small", which indicates a membership function for the current detection value I as an input variable. A membership value (for example, 0.4) is obtained by substituting the current detection value I into the membership function.

FIG. 18 (*c*) is a graph showing the conclusion "the input is somewhat large", which indicates a membership function for the duty cycle of the blower control triac as the conclusion part of rule 3. The smaller (0.3) of the membership values of the first and the second conditions of rule 3 is specified on the ordinate indicating the membership value of FIG. 18 (*c*). The region indicated by the membership function of FIG. 18 (*c*) is divided into two areas by a line corresponding to the specified membership value (0.3), and the region, indicated by oblique lines, which does not exceed the membership value corresponds to the inference result obtained by applying each of actually detected values to rule 3.

Figure 19:
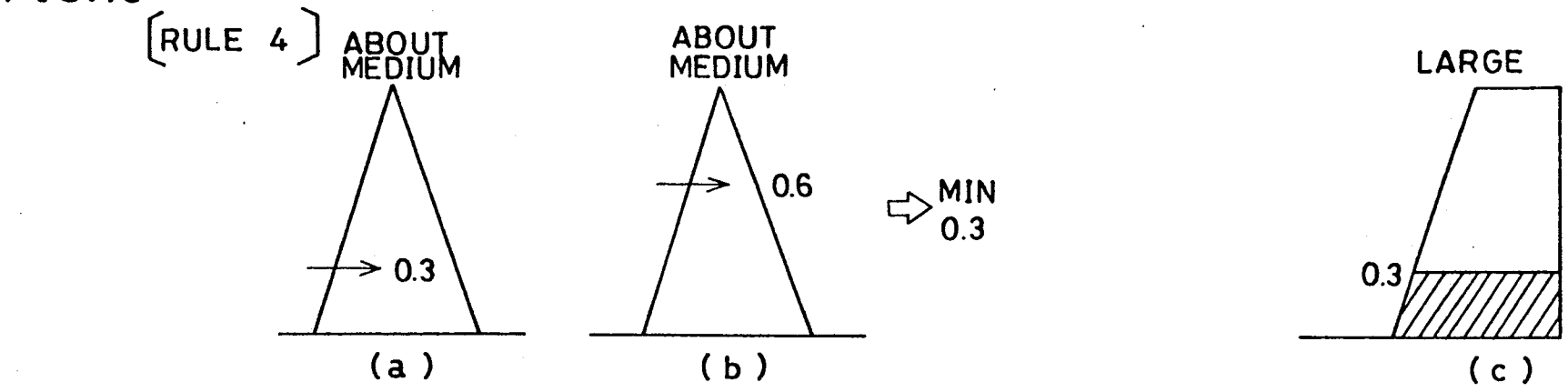
FIG. 19 is a graph illustrating a membership function of rule 4 of an embodiment of the present invention.

[Rule 4] is defined by such membership functions as are shown in FIGS. 19 (*a*), (*b*) and (*c*). FIG. 19 (*a*) is a graph for obtaining a membership value indicating the degree of satisfaction of the first condition of rule 4 "the pressure is about medium", which indicates a membership function for the pressure detection value P as an input variable. A membership value (for example, 0.3) is obtained by substituting the pressure detection value P into the membership function.

FIG. 19 (*b*) is a graph for obtaining a membership value indicating the degree of satisfaction of the second condition of rule 4 "the current is about medium", which indicates a membership function for the current detection value I as an input variable. A membership value (for example, 0.6) is obtained by substituting the current detection value I into the membership function.

FIG. 19 (*c*) is a graph showing the conclusion "the input is large", which indicates a membership function for the duty cycle of the blower control triac as the conclusion part of rule 4. The smaller (0.3) of the membership values of the first and second conditions of rule 4 is specified on the ordinate indicating the membership value of FIG. 19 (*c*). The region indicated by the membership function of FIG. 19 (*c*) is divided into two areas by a line corresponding to the specified membership value (0.3), and the region indicated by oblique lines, which does not exceed the membership value corresponds to an inference result obtained by applying each of the actually detected values to rule 4.

Figure 20:
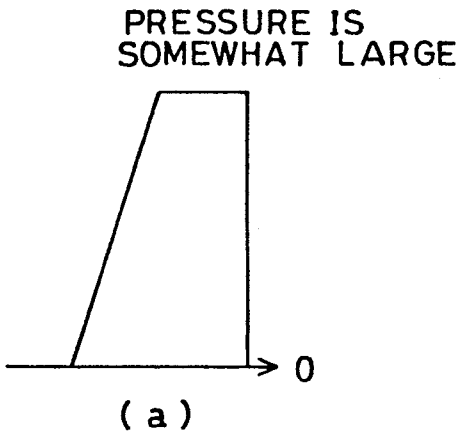
FIG. 20 is a graph illustrating a membership function of rule 5 of an embodiment of the present invention.
Figure 20:
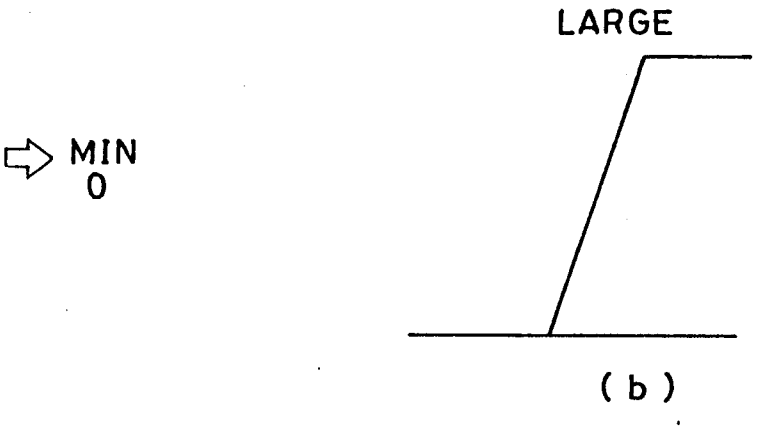

[Rule 5] is defined by such membership functions as are shown in FIGS. 20 (*a*) and (*b*). FIG. 20 (*a*) is a graph for obtaining a membership value indicating the degree of satisfaction of the first condition of rule 5 "the pressure is somewhat large", which indicates a membership function for the pressure detection value P as an input variable. A membership value zero is obtained by substituting the pressure detection value P into the membership function.

As described above, the membership value of the first condition is zero, so that the membership value zero of the first condition is specified on the ordinate of the membership function showing the conclusion "the input is large" in FIG. 20 (*b*) regardless of the membership value of the second condition. The region which does not exceed the membership value zero corresponds to an inference result obtained by applying each of the actually detected values to rule 5.

Figure 21:
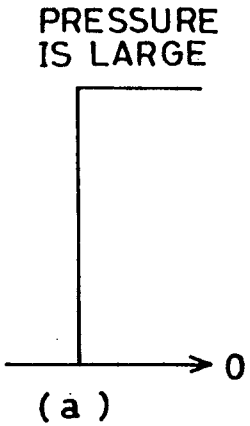
FIG. 21 is a graph illustrating a membership function of rule 6 of an embodiment of the present invention.
Figure 21:
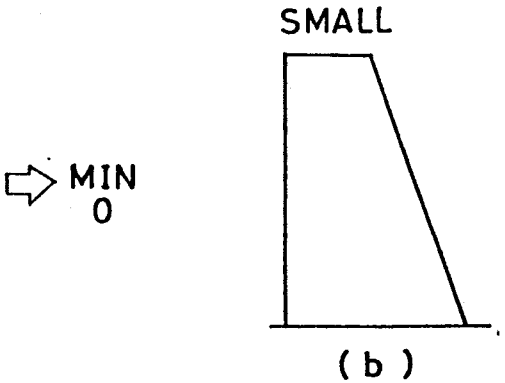

[Rule 6] is defined by such membership functions as are shown in FIGS. 21 (*a*) and (*b*). FIG. 21 (*a*) is a graph for obtaining a membership value indicating the degree of satisfaction of the first condition of rule 6 "the pressure is large", which indicates a membership function for the pressure detection value P as an input variable. A membership value zero is obtained by substituting the pressure detection value P into the membership function.

As described above, the membership value of the first condition is zero, so that the membership value zero of the first condition is specified on the ordinate of the membership function showing the conclusion "the input is small" of FIG. 21 (*b*) regardless of the membership value of the second condition. The region which does not exceed the membership value zero corresponds to an inference result obtained by applying each of the actually detected values to rule 6.

Figure 22:
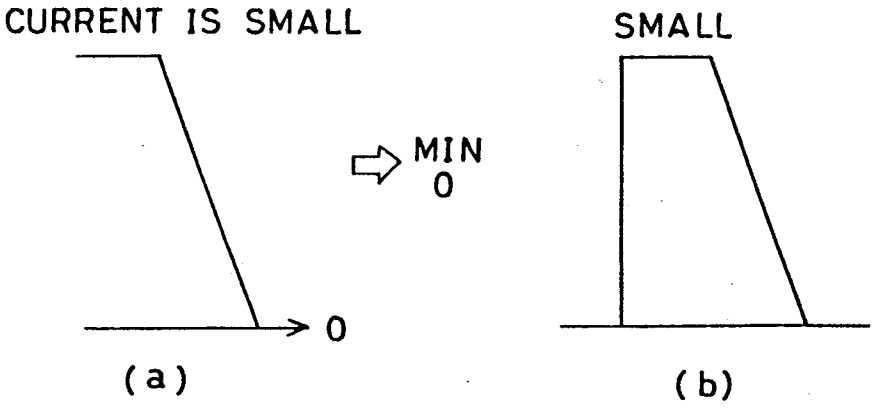
FIG. 22 is a graph illustrating a membership function of rule 7 of an embodiment of the present invention.

[Rule 7] is defined by such membership functions as are shown in FIGS. 22 (*a*) and (*b*). FIG. 22 (*a*) is a graph for obtaining a membership value indicating the degree of satisfaction of the condition of rule 7 "the current is very small", which indicates a membership function for the current detection value I as an input variable. A membership value zero is obtained by substituting the current detection value I into the membership function.

FIG. 22 (*b*) is a membership function showing the conclusion "the input is small", in which the membership value zero of the first condition is specified on the ordinate. The region which does not exceed the membership value zero corresponds to an inference result obtained by applying an actually detected value to rule 7.

Figure 23:
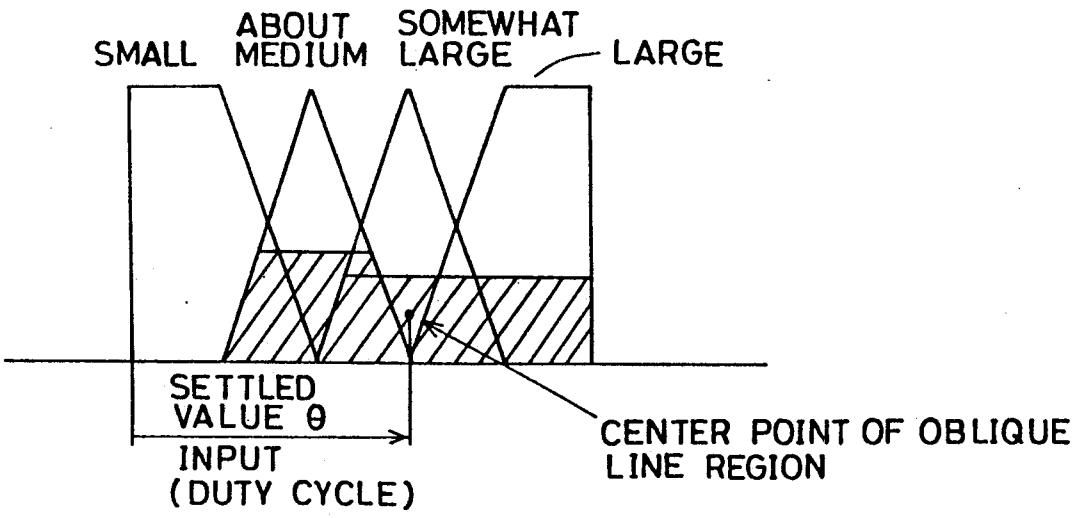
FIG. 23 is a graph illustrating a principle of evaluating an inference result according to an embodiment of the present invention.

Now, in consideration of the inference results for respective rules, a method of determining the duty cycle of the blower control triac will be described with reference to FIG. 23. The quadrangles indicated by oblique lines in FIGS. 16 (*c*), 18 (*c*), and 19 (*c*) are superimposed on a coordinate system common to these figures, and the function of FIG. 23 obtained as a result corresponds to a membership function showing the final inference result. Then, the position of the center point of the region, indicated by oblique lines, which is designated by the function is settled as the duty cycle of the blower control triac determined in consideration of all the conditions of rules 1 to 7.

A result obtained by performing the fuzzy inference procedure as described above on all possible pressure values P and current values I is represented in the look up table in FIG. 12.

Next, the effects of the above described respective rules on the input control operation of the electric blower will be described.

According to [Rule 1], where "the pressure is small" and "the current is somewhat small", the pressure in the dust collecting chamber is close to the atmospheric pressure and the load of the floor surface is small, so that input to the electric blower is controlled to about medium.

According to [Rule 2], where "the pressure is small" and "the current is large", a thick carpet is the subject of dust collection, and input to the electric blower is controlled to be large to suck the dust from deep in the carpet.

According to [Rule 3], where "the pressure is about medium" and "the current is somewhat small", the amount of the dust in dust collecting chamber is increased although the load of the floor surface is small, so that input to the electric blower is increased to increase suction power.

According to [Rule 4], where "the pressure is about medium" and "the current is about medium", the amount of the dust in the dust collecting chamber is increased, and a tatami mat or thin carpet is the subject of dust collection, so that input to the electric blower is increased for increased suction power.

According to [Rule 5], where "the pressure is somewhat large" and "the current is about medium", a considerable amount of dust is collected in the dust collecting chamber, and a tatami mat or thin carpet is the subject of dust collection, so that input to the electric blower is increased for increasing suction power.

According to [Rule 6], where "the pressure is large" and "the current is very small", there is an abnormal situation such as where the dust collecting chamber is full of dust, or some part of the suction passage is clogged with something, so that input to the electric blower is suppressed.

According to [Rule 7], where "the current is very small", the floor nozzle is in the air, and there is no suction load, so that input to the electric blower is decreased.

On the other hand, if sliding operation part 23 of operation notch controlling part 39 is switched from the fuzzy control position to any of the manual control positions "weak"–"high power", a signal responding to the control position is supplied as an input to microcomputer 38, blower control triac 37 is controlled on the basis of the signal, and power corresponding to the selected manual control position is supplied to electric blower 7.

As described above, according to an embodiment of the present invention, a method of controlling an input to electric blower 7 to be an optimum value corresponding to the condition of a floor surface is carried out by performing the fuzzy inference procedure on the pressure P in the vicinity of suction port *7a* of electric blower 7 and the current I of brush-driving motor 19. However, if all combinations of pressure P and current I are stored, and input to electric blower 7 is controlled on the basis of the combination of the actually detected pressure P and current I, for example, without employing the fuzzy inference procedure, it is also possible to implement suction power in accordance with the condition of a floor surface.

Furthermore, according to an embodiment of the present invention, a current sensor detecting the current in rotary brush-driving motor 19 is used as the floor sensor, while, additionally, a sensor detecting the coefficient of friction or the degree of unevenness of a floor surface, for example, may be utilized as the floor sensor.

As described, according to an embodiment of the present invention, the pressure in the vicinity of the suction port of the electric blower and the current value of the brush-driving motor is detected, and input to the electric blower is controlled on the basis of the result of mathematical operations carried out on these detected values, so that it is possible to supply optimum power to the electric blower in accordance with the condition of a floor surface and to realize optimum suction power as well.

Furthermore, it is possible to perform automatic control of the input to the electric blower adapted to human experience or intuition in a simple way using simple mathematical operations of membership functions, without employing complicated control expressions or a very large memory, by performing mathematical operations on these detected values by the fuzzy inference procedure.

Furthermore, according to an embodiment of the present invention, the current in brush-driving motor 19 is detected with the current sensor, and input to the electric blower is controlled on the basis of the peak value of the detected value, so that it is possible to precisely determine the condition of a floor and to control of input to the electric blower to be an optimum value as well.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electric vacuum cleaner comprising:

a main body having an electric blower and a dust collecting chamber, a floor nozzle coupled to said main body, pressure sensing means for sensing a pressure difference from a suction side of said electric blower in relation to an ambient pressure and for sending a first signal responsive thereto, floor sensing means for inferring the condition of a floor surface and for sending a second signal responsive thereto, and control means for performing a plurality of prescribed mathematical operations on values of the magnitudes of said first and said second signals to control the amount of power supplied to said electric blower in a predetermined correlation with the value of a result of said operations.

2. The electric vacuum cleaner according to claim 1, wherein said floor nozzle includes a rotary brush and a brush driving motor for driving said rotary brush, and said floor sensing means includes a current sensor for sensing the current flowing in said brush driving motor.

3. The electric vacuum cleaner according to claim 2, wherein said floor sensing means further includes a peak hold circuit for holding a peak value of an electric current sensed with said current sensor for a first prescribed period of operation of said vacuum cleaner.

4. The electric vacuum cleaner according to claim 3, wherein said control means includes means for detecting a maximum value of an output of said peak hold circuit for a second prescribed period longer than said first period to control a supply of power to said electric blower on the basis of said maximum value.

5. The electric vacuum cleaner according to claim 4, wherein said first prescribed period is a period corresponding to a one of a half cycle and a whole cycle of the power supply frequency.

6. The electric vacuum cleaner according to claim 5 further comprising zero crossing signal generating means for defining said first prescribed period.

7. The electric vacuum cleaner according to claim 4, wherein said second prescribed period is approximately 1.5 seconds.

8. An electric vacuum cleaner comprising:

a main body having an electric blower and a dust collecting chamber, a floor nozzle coupled to said main body, pressure sensing means for sensing a pressure difference from a suction side of said electric blower in relation to an ambient pressure and for sending a first signal responsive thereto, floor sensing means for inferring the condition of a floor surface and for sending a second signal responsive thereto, and control means for performing a fuzzy inference procedure on values of the magnitudes of said first and said second signals to control the amount of power supplied to said electric blower in a predetermined correlation with the value of the result of said fuzzy inference procedure.

9. The electric vacuum cleaner according to claim 8, wherein said floor nozzle includes a rotary brush and a brush driving motor for driving said rotary brush, and said floor sensing means includes a current sensor for sensing a current flowing in said brush driving motor.

10. The electric vacuum cleaner according to claim 9 further comprising a triac for controlling said electric blower.

11. The electric vacuum cleaner according to claim 10, wherein said fuzzy inference procedure employs an output of said pressure sensing means and an output of said current sensor as input variables, and employs a duty cycle of said triac as a conclusion part.

12. The electric vacuum cleaner according to claim 9, wherein said floor sensing means further includes a peak hold circuit for holding a peak value of the current sensed with said current sensor for a first prescribed period of operation of said vacuum cleaner.

13. The electric vacuum cleaner according to claim 12, wherein said control means includes means for detecting a maximum value of an output of said peak hold circuit for a second prescribed period longer than said first period to control a supply of power to said electric blower on the basis of said maximum value.

14. The electric vacuum cleaner accccrding to claim 13, wherein said second prescribed period is approximately 1.5 seconds.

15. The electric vacuum cleaner according to claim 13, wherein said first prescribed period is a period corresponding to a one of a half cycle and a whole cycle of the power supply frequency.

16. The electric vacuum cleaner according to claim 15 further comprising zero crossing signal generating means for defining said first prescribed period.

* * * * *